United States Patent [19]

Gabriels

[11] 4,448,129

[45] May 15, 1984

[54] TELESCOPIC PROJECTILE

[75] Inventor: André J. Gabriels, Genk, Belgium

[73] Assignee: Fabrique Nationale Herstal, Belgium

[21] Appl. No.: 208,809

[22] Filed: Nov. 20, 1980

[30] Foreign Application Priority Data

Nov. 30, 1979 [BE] Belgium ..... 2/58240
Oct. 10, 1980 [BE] Belgium ..... 2/58794

[51] Int. Cl.[3] ..... F42B 27/00

[52] U.S. Cl. ..... 102/487; 102/256; 102/484; 102/493

[58] Field of Search ..... 102/482–484, 102/487–488, 251, 252, 473, 491, 493, 221, 222, 499, 500, 485, 272, 247, 254, 256, 259, 237, 244, 226 O; 42/1 F

[56] References Cited

U.S. PATENT DOCUMENTS

| | | | |
|---|---|---|---|
| 1,463,993 | 8/1923 | Burt | 102/484 |
| 2,712,284 | 7/1955 | Thomas et al. | 102/251 X |
| 2,883,781 | 4/1959 | Harvey | 42/1 F |
| 3,675,579 | 7/1972 | Men | 102/229 |
| 3,820,464 | 6/1974 | Dixon | 102/495 |
| 3,886,841 | 6/1975 | Smith et al. | 102/374 |
| 4,008,667 | 2/1977 | Look | 102/502 |
| 4,029,014 | 6/1977 | Cunningham | 102/222 |

FOREIGN PATENT DOCUMENTS

| | | | |
|---|---|---|---|
| 79094 | 2/1894 | Fed. Rep. of Germany | 102/473 |
| 177271 | 6/1905 | Fed. Rep. of Germany . | |
| 310610 | 2/1920 | Fed. Rep. of Germany . | |
| 340814 | 9/1921 | Fed. Rep. of Germany . | |
| 945081 | 4/1949 | France . | |
| 107953 | 1/1966 | Norway | 102/483 |
| 361738 | 6/1962 | Switzerland . | |

*Primary Examiner*—Harold J. Tudor
*Attorney, Agent, or Firm*—Bacon & Thomas

[57] ABSTRACT

The invention relates to a projectile having a head extended by a tubular tail and containing an explosive charge as well as a firing chain for the latter. The tail is made of two telescopic tubular parts, one of which is integral with the head and together with the head carries a first part of the firing chain, the other carrying the remaining part of the firing chain, and guiding means that are distributed over the two parts in order to assign them a determined angular position depending on their relative axial position.

16 Claims, 19 Drawing Figures

TELESCOPIC PROJECTILE

BACKGROUND OF THE INVENTION

This invention relates to a telescopic projectile such as e.g. a grenade to be fired by means of a rifle.

SUMMARY OF THE INVENTION

An object of the present invention is to keep down the cost of such projectiles by replacing the usual firing devices (such as mechanical rockets) electromechanical rockets and the like), launching devices and fragmentation devices by much simpler means without projudicing, however, the efficiency or reliability and the reliability in service.

Another object of the present invention is to reduce the bulkiness of the said projectiles during their transport and/or storage.

A further object of the present invention is to improve the efficiency of such projectiles, especially for anti-personel use.

A still further object is to increase the sensitivity of the projectile upon impact.

For these purposes the present invention proposes a projectile with a head extended by a tubular tail and containing an explosive charge as well as pyrotechnical chain for the latter, which projectile is characterized in that said tail is made of two telescopic parts, one of which forming one piece with said head and together with the head carries a first part of said chain and the other part of which carries the remainder of the firing chain, and guiding means that are distributed over said two parts in order to assign them relative angular positions determined as a function of their relative axial positions.

These guiding means are such that the projectile can be brought in the following states:

1. storage and transport: both tail parts are telescoped and the pyrotechnical chain is interrupted or not aligned;
2. launching: both tail parts are extended as far as possible and the pyrotechnical chain is not aligned;
3. beginning of trajectory: both tail parts return to their telescopic state by performing a relative rotation bringing along the alignement of the pyrotechnical chain;
4. flight and impact: both tail parts are telescoped and the pyrotechnical chain is aligned.

BRIEF DESCRIPTION OF THE DRAWINGS

For clarity's sake an embodiment of the invention is described hereinafter for illustration only without limiting the scope of the invention and shown in the accompanying drawings wherein.

DESCRIPTION OF THE PREFERRED EMBODIMENTS

Figures 1, 4, 5:
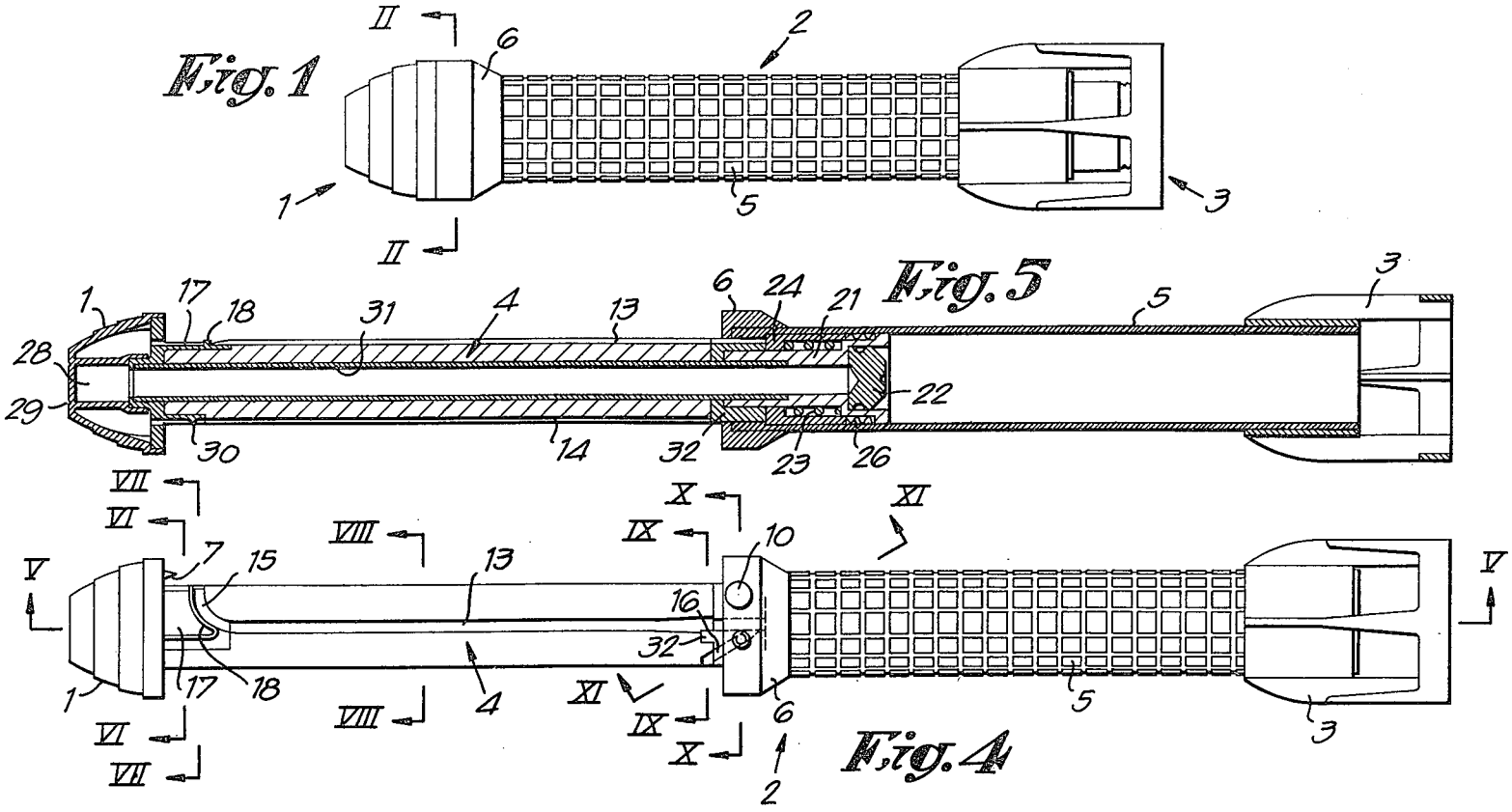
FIG. 1 represents a projectile according to the invention in its storage and transport state.
FIG. 4 represents a view of the projectile according to FIG. 1 in position of launching.
FIGS. 5 to 11 represent sections according to lines V—V to XI—XI of FIG. 4, FIG. 11 being a partial section on a larger scale.
Figure 2:
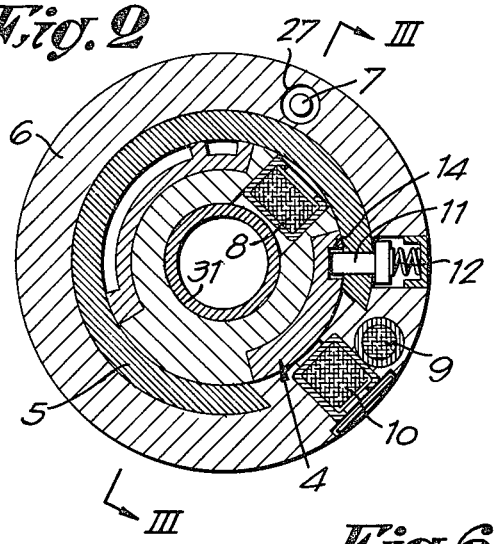
FIG. 2 represents a section according to line II—II of FIG. 1.

The projectile represented in FIGS. 1 to 16 comprises a head 1 and a tubular telescopic tail 2 with vanes 3.

Tail 2 is made of two parts one of which is a first telescoping tubular part 4, integral with head 1, the other one 5 is a second telescoping tubular part which is capable of sliding over the part 4.

The front end of part 5 is provided with a collar 6 whose form completes that of head 1, when the projectile is in the position of FIG. 1 or at the moment of impact.

The body of tail part 4 constitutes the explosive charge of the projectile. This explosive charge is composed, e.g., of a secondary explosive such as hexogene, octogene or penthrite, and a plastic binder such as nylon, polybutadiene, polyurethane, polyester and others. This explosive charge may be manufactured according to known processes of casting or compression depending on the type of binder. Part 5 is formed of prefragmentated metal.

The pyrotechnical chain of firing comprises on the one hand a firing-pin 7 provided at the rear face of head 1 and of a secondary relay 8 inserted in said explosive charge, and, on the other hand of a percussion cap 9 and a primary relay 10 accommodated in the front end of said collar 6.

Guiding means are distributed over first and second tubular parts 4 and 5, respectively, in order to impose thereon relative angular positions chosen as a function of their respective axial positions. In the represented example these means consist of a set of grooves, detailedly described hereinafter, provided in the body of part 4, and of a spring-loaded pin 11 provided in collar 6.

This set of grooves comprises two grooves 13 and 14 extending along two generatrices of body 4 and, in the present case, being 180° apart.

At its end nearest to head 1 groove 13 is extended by a curved part 15 ending below the firing pin 7. At its other end groove 13 connects to groove 14 by a connecting groove 16.

A cavity 17 is provided between head 1 and the curved part 15 separated from the latter by a thin wall 18.

Positioning projections 19 and 20 are provided in the bottom of groove 16 (FIG. 11) and 15 (FIG. 15) respectively.

The rear end of part 4 is provided with a tail piece 21 serving as a support, on the one hand to a gascheck 22 (such as described in the Application of the Applicant), and on the other hand to an outer spring 23 resting on an annular thrust collar 24 engaging an intern projection 25 of said part 5. A deformable safety element 26 is provided between the end of the tail piece 21 and the annular thrust collar 24.

Collar 6 has a recess 27 for housing the firing-pin 7 when the projectile is in the state of FIG. 1 (transport).

The bore of the first tubular part 4 is extended by a corresponding passage 28 in the head 1 whose front wall is provided with a circular weakening zone 29.

In the illustrated embodiment there is a projection 30 in the bottom of groove 14 and a blast-tube 31 in the body 4 ending in a sleeve 32.

The above-described projectile is used and functions as follows.

Figure 3:
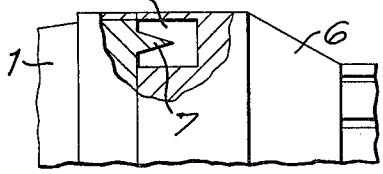
FIG. 3 represents a fragmentary section according to line III—III of FIG. 2.
Figure 8:
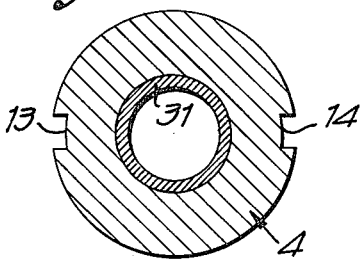
Figure 6:
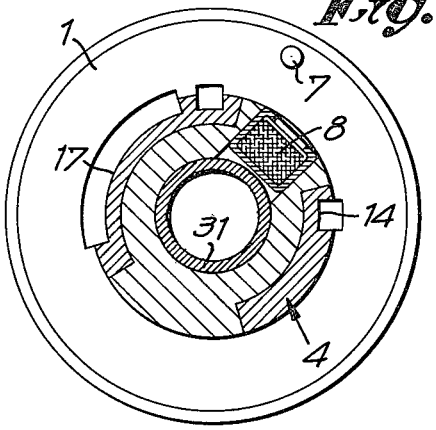
Figure 9:
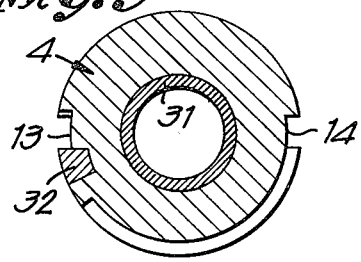
Figure 7:
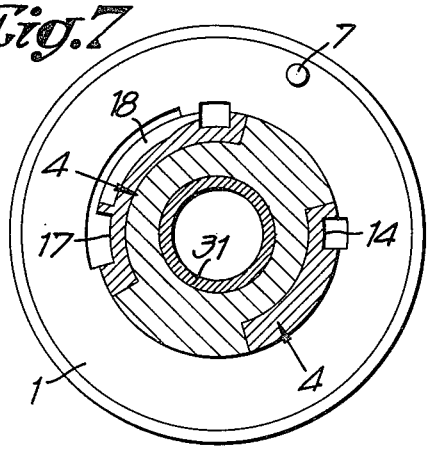
Figure 10:
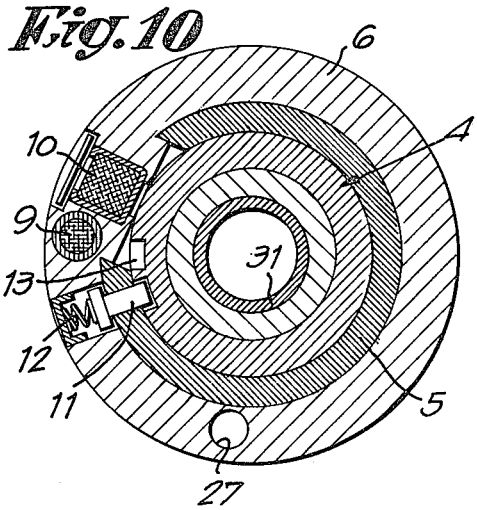
Figure 11:
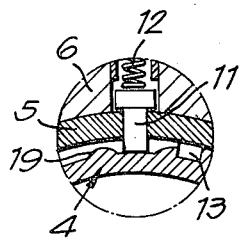
Figure 12:
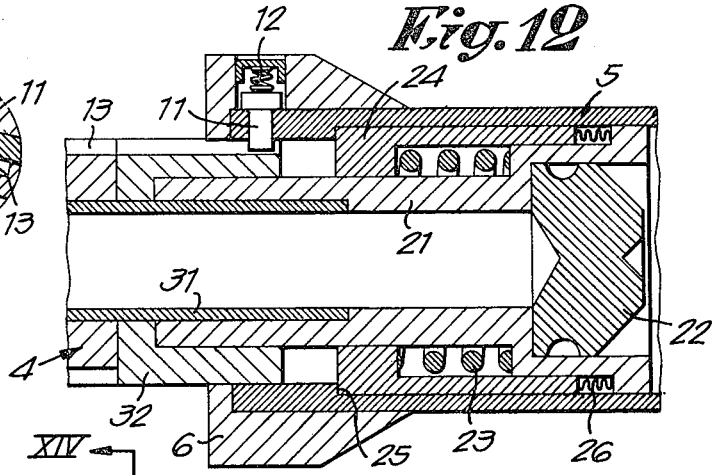
FIG. 12 represents a larger-scale view of the central part of FIG. 5, but at the start of the projectile.
Figure 13:
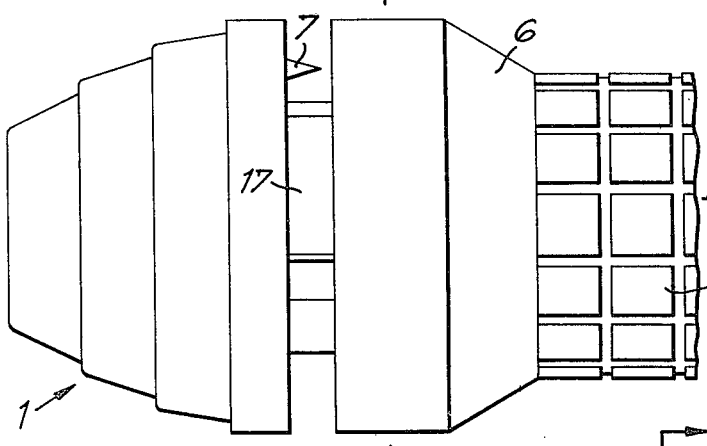
FIG. 13 represents the front part of the projectile in its ready-to-impact position.
Figure 15:
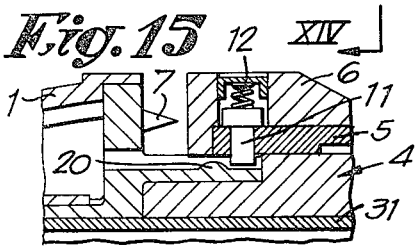
FIGS. 15 and 16 represent partial sections according to lines XV—XV and XVI—XVI of FIG. 14.
Figure 16:
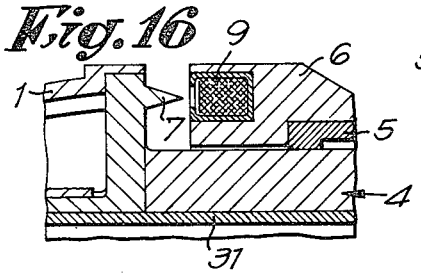
Figure 14:
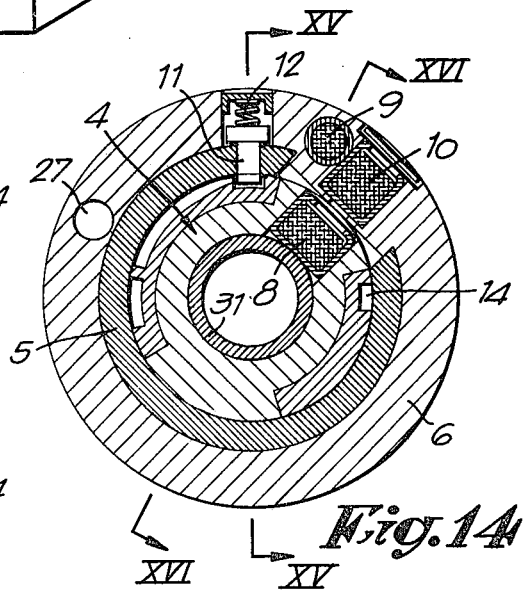
FIG. 14 represents a section according to line XIV—XIV of FIG. 13.

In the storage-transport position (FIG. 1) part 5 occupies such an angular position with respect to head 1 and part 4 that point 7 is positioned in recess 27 (FIG. 3). So, the projectile presents a minimum of room occupied and its pyrotechnical chain is not aligned (see FIG. 2). Parts 4 and 5 are mutually locked in this position by the engagement of pin 11 behind projection 30 (FIG. 5) provided in the bottom of groove 14.

For bringing the projectile into firing position (FIGS. 4 and 5) the user holds the head with one hand and with the other he exerts a pulling force on part 5. The pin 11 clears the above-mentioned projection and traverses groove 14 and then groove 16 at the end of which it places itself between the projections 19. To manually advance part 5 still further is impossible because of the safety element 26. Tail part 5 can now receive the barrel of a rifle used for launching.

Launching can be performed by means of a special propulsive cartridge or a usual ball cartridge.

If launching is performed by means of ball munition, the ball goes through the gascheck 22 which closes itself behind it, which prevents the propulsive gases from escaping. The bullet traverses the explosive charge 4 through the central channel defined by tubes 31, arrives in the passage 28 of head 1 and escapes from head 1 by rupturing zone 29.

At the moment of discharge, the head 1 and tail part 4 receives all the thrust and is accelerated with respect to tail part 5. This causes the permanent deformation by collapse of safety element 26, the compression of spring 23 and the entering of pin 11 into groove 13 (see FIG. 12). Immediately after the discharge part 5 catches up with the head 1 and tail part 4 under the joint action of the expansion, of spring 23, of the weight difference between the aforesaid elements (the first tail part being lighter than the second), and of the difference of their respective aerodynamic coefficients.

Pin 11 traverses groove 13. If the projectile would meet an obstacle during this phase, pin 11 would fracture the thin wall 18 and enter the cavity 17. In this position, firing of the percussion cap 9 cannot take place, as the latter is not an alignment with firing-pin 7. This constitutes the safety of the trajectory start.

When pin 11 enters curved groove part 15 it causes a rotation of part 5 with respect to the parts 1, 4. The projectile is now in the position of FIGS. 13 to 16, in which position the pyrotechnical chain is in alignment. The projection 20 prevents any subsequent progression of part 5 until impact.

A very high sensitivity to the firing of the pyrotechnical chain, even under very small impact angles, is realized thanks to the outer form of head 1, which adheres more easily to the obstacle.

The sensitivity is still enhanced by the large mass of part 5, which in collar 6 carries the percussion cap 9. This high mass is set in movement at the moment of impact of the projectile and communicates all its energy to the percussion cap when the latter strikes the firing-pin 7.

After firing of the pyrotechnical chain, tail part 5 gives rise to an amount of fragments under the action of detonation of the explosive charge 4.

For still more safety a breakable thin wall could be provided in groove 16.

Figure 17:
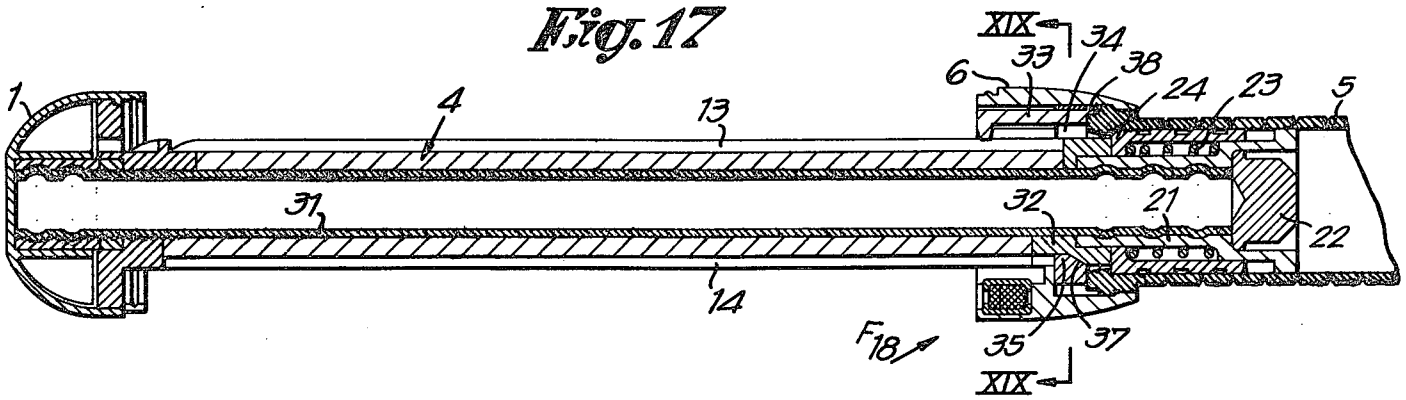
FIG. 17 represents a view similar to that of FIG. 5 of an interesting embodiment of the present invention.
Figure 19:
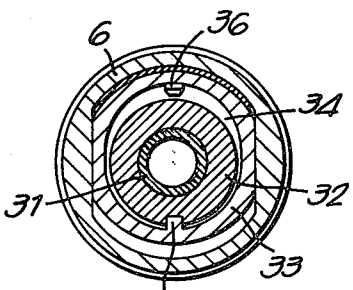
FIG. 19 represents a section according to line XIX—XIX of FIG. 17.
Figure 18:
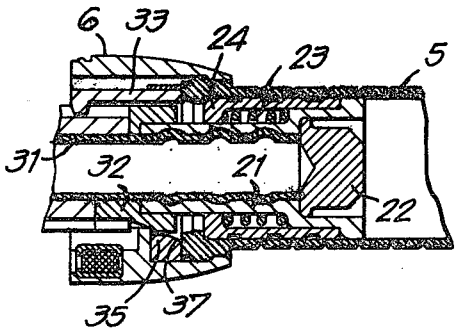
FIG. 18 represents the part of FIG. 17 indicated by the arrow F18 in another characteristic position.

In the above-described embodiment the user needs his two hands for bringing the projectile in firing position, as he must hold the head 1 with one hand and part 5 with the other. This can be avoided by the embodiment represented in FIGS. 17–19 wherein the elements identical with, or equivalent to those of FIGS. 1 to 16 keep the same reference numbers.

This embodiment differs essentially from the foregoing by the following constructive measures:

the connection groove 16 has been omitted;

the collar 6 comprises a ring 33 with oblong opening 34 (see FIG. 19) and carries two pins 35 and 36 respectively, being 180° apart;

the sleeve 32 is provided with a slope 37;

the ring 33 is provided with a projection 38 intended for resting on the front part of tail 5.

During storage and transport, projection 38 is engaged in its housing so that pin 35 of ring 33 is engaged in groove 14, the pin 36 projecting over groove 13.

For preparing the projectile for launching it suffices to place it in the telescopic state and to insert in it the barrel of the weapon used for launching. This brings the projectile in the position of FIG. 17, pin 35 butting against slope 37.

At the instant of firing, inertia causes the compression of spring 23, the pressing back of pin 35 out of groove 14 by slope 17 with rupture of projection 38, and the movement of pin 36 into groove 13 by lateral movement of sleeve 32 in oblong opening 34. Thereupon the projectile behaves as in the foregoing example.

Obviously many modifications can be made to the above-described example without limiting, however, the scope of the invention. Thus the presence of spring 23 is not indispensable if the forms and weights of the elements are judiciously chosen.

I claim:

1. A projectile having a head and a tubular tail, the projectile containing an explosive charge and a firing chain therefor, the tail comprising first and second telescopically related tubular parts, said first telescopic part is fixed to said head and includes a first part of said firing chain, said second telescopic tubular part includes the remaining parts of the firing chain, and interengaging guiding means on said first and second telescopically related tubular parts to relatively rotate said first and second tubular parts in response to relative longitudinal telescopic movement of said first and second telescopically related parts to bring said first part of said firing chain into radial and functional alignment with said remaining parts of the firing chain.

2. A projectile according to claim 1, wherein said first tubular part consists mainly of an explosive charge.

3. A projectile according to claim 2, wherein said second tubular part is made of pre-fragmented metal and surrounds said first tubular part in the absence of relative longitudinal displacement.

4. A projectile according to claim 1, wherein said first part of the firing chain consists of a firing pin integral with the rear part of said head and a secondary relay countersunk in said explosive charge, said remaining parts of the firing chain consists of a percussion cap and a primary relay carried by said second telescopic tubular part.

5. A projectile according to claim 1, wherein at least one groove is provided in said first telescopic tubular part and at least one pin is provided on said second telescopic tubular part; said pin received in said groove to provide said guiding means upon said relative longitudinal telescopic movement of said first and second telescopic tubular parts.

6. A projectile according to claim 5, wherein said guiding means comprises two grooves extending along two generatrices of said first telescopic tubular part, one end of one of said grooves being extended by a curved groove portion in the proximity of the head of said projectile.

7. A projectile according to claim 6, wherein a cavity is provided between said curved groove portion and said head and is separated from said curved groove portion by a thin wall so that said thin wall may be fractured by said pin by inertial forces so as to disable said firing chain.

8. A projectile according to claim 6, wherein said guiding means further includes a connection groove interconnecting ends of said two grooves; said connection groove located at a distal end from said head carried by said first telescopic tubular part.

9. A projectile according to claim 6, wherein a collar includes an internal ring provided with first and second pins; said first pin engaged in one of said two grooves; and, means for displacing said ring perpendicular to the axis of said second tubular part so as to remove said first pin from said one of said two groove and place said second pin into the remaining one of said two grooves.

10. A projectile according to claim 9, wherein a sleeve is provided with a sloping surface interiorly of said collar, said elastic means operatively connected to said sleeve so that upon movement of said second telescopic tubular part toward said head, said sloping surface contacts and releases said first pin from said first groove and guides said second pin into said second groove.

11. A projectile according to claim 5, wherein said pin is spring-loaded in a collar portion of said second telescopic tubular part, said pin extending into at least one of said grooves and guiding said first and second tubular parts during said relative longitudinal telescopic movement of said first and second tubular parts.

12. A projectile according to claim 11, wherein said grooves are provided with projections so as to guide said pin in said grooves when said first part of said firing chain is brought into radial and functional alignment with said remaining parts of the firing chain.

13. A projectile according to claim 1, wherein said first telescopic tubular part carries an elastic means for biasing said second telescopic tubular part toward said head.

14. A projectile according to claim 13, wherein safety means is provided between said collar and a support member of said elastic means so as to prevent biasing action of said elastic means prior to firing said projectile.

15. A projectile according to claim 1, wherein said head and said first telescopic tubular part weighs less than said second telescopic tubular part.

16. A projectile according to claim 1, wherein said head and said first telescopic tubular part have an aerodynamic coefficient resulting in greater air resistance than that of said second telescopic tubular part.

* * * * *